US011352750B2

(12) United States Patent
Shanmuganathan et al.

(10) Patent No.: US 11,352,750 B2
(45) Date of Patent: Jun. 7, 2022

(54) SHAPED OBJECTS FOR USE IN SECURITY APPLICATIONS

(71) Applicant: Council of Scientific & Industrial Research, New Delhi (IN)

(72) Inventors: Kadhiravan Shanmuganathan, Pune (IN); Premnath Venugopalan, Pune (IN); Tushar Ambone, Pune (IN)

(73) Assignee: Council of Scientific & Industrial Research, New Delhi (IN)

( * ) Notice: Subject to any disclaimer, the term of this patent is extended or adjusted under 35 U.S.C. 154(b) by 0 days.

(21) Appl. No.: 16/648,136

(22) PCT Filed: Sep. 20, 2018

(86) PCT No.: PCT/IN2018/050613

§ 371 (c)(1),
(2) Date: Mar. 17, 2020

(87) PCT Pub. No.: WO2019/058392

PCT Pub. Date: Mar. 28, 2019

(65) Prior Publication Data

US 2020/0217017 A1 Jul. 9, 2020

(30) Foreign Application Priority Data

Sep. 22, 2017 (IN) ..... 201711033661

(51) Int. Cl.

| | |
|---|---|
| ***D21H 21/40*** | (2006.01) |
| ***B42D 25/355*** | (2014.01) |
| ***B42D 25/21*** | (2014.01) |
| ***B42D 25/36*** | (2014.01) |
| ***D21H 17/67*** | (2006.01) |
| ***B42D 25/387*** | (2014.01) |
| ***D21H 17/36*** | (2006.01) |
| ***D21H 17/68*** | (2006.01) |

(52) U.S. Cl.

CPC ..... *D21H 21/40* (2013.01); *B42D 25/355* (2014.10); *B42D 25/387* (2014.10); *D21H 17/36* (2013.01); *D21H 17/675* (2013.01); *D21H 17/68* (2013.01); *B42D 25/21* (2014.10)

(58) Field of Classification Search

CPC ..... D21H 21/40; D21H 17/36; D21H 17/675; D21H 17/68; D21H 11/18; D21H 17/67; B42D 25/355; B42D 25/387; B42D 25/21; B42D 25/36

USPC ..... 283/67, 70, 72, 74, 94, 98, 901

See application file for complete search history.

(56) References Cited

U.S. PATENT DOCUMENTS

| | | | | |
|---|---|---|---|---|
| 4,943,093 | A | 7/1990 | Melling et al. | |
| 2011/0130508 | A1* | 6/2011 | Pendley | C09J 175/04 524/507 |

FOREIGN PATENT DOCUMENTS

| | | | |
|---|---|---|---|
| EP | 2 372 019 | A1 | 10/2011 |
| EP | 3 228 744 | A1 | 10/2016 |
| JP | 2017-056564 | A | 3/2017 |

(Continued)

*Primary Examiner* — Justin V Lewis

(74) *Attorney, Agent, or Firm* — Dilworth & Barrese, LLP

(57) ABSTRACT

The present invention disclosed a shaped object comprising nano cellulose alone or a composition of nano cellulose for inclusion in a paper product and process for preparation thereof. The present invention further disclosed a paper product having the shaped objects incorporated therein. The shaped objects are used as a security feature for identifying and authenticating security documents.

17 Claims, 5 Drawing Sheets

(56) References Cited

FOREIGN PATENT DOCUMENTS

| | | | |
|---|---|---|---|
| WO | 2007/144657 | A2 | 12/2007 |
| WO | 2010/040991 | A1 | 4/2010 |
| WO | 2010/077837 | A2 | 7/2010 |
| WO | 2011/039199 | A1 | 4/2011 |
| WO | 2011/055148 | A1 | 5/2011 |
| WO | 2012/049514 | A3 | 4/2012 |
| WO | 2013/178986 | A1 | 12/2013 |
| WO | 2014/118466 | A1 | 8/2014 |
| WO | 2017/155456 | A1 | 9/2017 |

* cited by examiner

SHAPED OBJECTS FOR USE IN SECURITY APPLICATIONS

FIELD OF THE INVENTION

The present invention relates to a shaped object as security feature for use in identifying and authenticating security documents. More particularly, the present invention relates to a shaped object comprising nanocellulose alone or a composition of nanocellulose for inclusion in a paper product and process for preparation thereof. The present invention further relates to a paper product having shaped objects incorporated therein

BACKGROUND AND PRIOR ART

The printing of currency notes involves significant cost, time and administrative effort to the government. Although treasury departments continue to develop cutting-edge security features for currency notes, such as raised print, watermarks, holograms, and security threads, however counterfeiters stay one step ahead in producing fraudulent documents. The problems with known counterfeit protection measures include the expense of some options and the ease with which some options can be overcome, for example by utilizing methods including digital or laser printing, scanning, photography and xerography. To detect and curb such criminal activities, security features needs to be constantly upgraded with new technology.

WO2007144657 discloses a planchette for inclusion in a paper product, the planchette comprising one or more regions, wherein the regions are coloured and the colours are visible only under ultra-violet light, and wherein the planchette has a complex shape.

EP3228744A1 discloses a use of nano cellulose for increasing dog ear resistance of a paper product, a method of manufacturing a semi-finished paper product suitable for manufacturing a valuable document, a semi-finished paper product as well as a valuable document comprising the nano cellulose coated semi-finished paper product.

EP2372019A1 discloses a security fibre in the form of a small strip of paper (1; 51; 52) is suitable for incorporation into a paper product, for use in counterfeit protection. In example embodiments of the invention, the security fibre (1; 51; 52) comprises (i) a central region (2) made up of a plurality of different colours (21; 22; 23; 24), and (ii) a sacrificial margin (3; 31; 32; 33; 34) adjacent to the coloured region (2). The margin (3; 31; 32; 33; 34) includes a varnish.

WO2010040991 discloses a security fibre for use in counterfeit protection, the security fibre being suitable for incorporation into a paper product, the security fibre being in the form of a sheet of paper or cellulose-based substrate and comprising a coloured region, wherein the coloured region is made up of a plurality of different colours, characterized in that the security fibre also comprises a first margin and a second margin, the margins being unprinted regions adjacent to the coloured region, such that the coloured region is situated between the first and second margins.

WO2010077837 discloses a planchette comprising a combination of a substrate and a composition containing at least one inconstant pigment or dye, wherein the composition is deposed on at least one surface of the substrate. The present invention describes planchettes incorporated into the substrate of secure articles, such as bank notes, passports and tax stamps. These planchettes may take various forms, such as fibers; regular shapes (such as circles or stars); irregular shapes (such as polygons); or as threads or stripes running throughout the length of the document and are colored with an ultra color inconstant pigment or dye.

WO2012049514 discloses a planchette for a security paper, a security paper containing a plurality of the planchettes, a method for making the planchette and a method for making the security paper. The present invention provides, in a first aspect, a planchette for a security paper, the planchette being a sheet having a first face and a second face, the first face having a first colour and the second face having a second, different, colour. The first face may have a colorant of a first colour and the second face may have a colorant of a second colour.

WO2011039199 discloses a security feature, for inclusion in a pulp from which a security paper (50) is to be made, is a sheet (10). The security feature includes a first pigment that fluoresces in response to illumination by UV light of a first, longer, wavelength, and a second, different, pigment that fluoresces in response to illumination by UV light of a second, shorter, wavelength. The sheet (10) is divided into a plurality of regions (20). The first pigment is in a first region, and the second pigment is in a second, different, region.

WO2013178986 discloses the use of a particular form of cellulose fibre known as microfibrillated cellulose (MFC), which is incorporated into and/or applied to the surface of a paper substrate, to improve the strength of security documents, such as banknotes, made from the substrate and to reduce their uptake of soil due to day to day handling.

The currently available solutions in the prior art are in the form of short fibres randomly distributed in the paper and the fibres exhibit single or multiple fluorescence bands when exposed to UV light. One known solution is to incorporate a number of small discs of coloured paper into a paper product and to use the visual effect generated by the planchettes as an anti-counterfeiting measure. Such arrangements offer many advantages, but suffer from problems including the ease with which some schemes can be replicated by printing, and the need to educate users to check for the presence of the planchettes. Further bending/folding/losing of shape is observed in when conventional paper based planchettes are used inside security paper. Also, the planchettes known in the prior art suffer from the problems like water absorption/swelling resulting in softness of the planchettes when introduced in pulp.

Therefore, to overcome the problems in the prior art including bending/folding/losing of shape of planchettes/objects while incorporating in security paper there is need to provide planchettes/objects for incorporation in security paper which have high stiffness so that the shape of planchettes/object will not distort while making the paper products. Accordingly, the present invention provides a shaped object for use in security application having high stiffness and which will retain their shapes after incorporating in paper product.

OBJECTIVE OF THE INVENTION

The main objective of the present invention is to provide a shaped object comprising nanocellulose alone or composition thereof.

Another objective of the present invention is to provide a shaped object made of nanocellulose alone or composition thereof for use in security application having high stiffness and which will retain their shapes after incorporating in paper product.

Yet another objective of the present invention is to provide a process for preparing the shaped object.

Still another objective of the present invention is to provide a paper product for use in security application, wherein a shaped object is incorporated in the paper product and the shaped object is visible in transmitted light, but is not visible in reflected light.

Yet still another objective of the present invention is to provide a process for making paper product having shaped object incorporated therein.

SUMMARY OF THE INVENTION

Accordingly, the present invention provides a security feature comprising nanocellulose alone or a composition of nanocelllulose in the form of a shaped object for security application or identifying and authenticating security document.

In an embodiment, the shaped object may additionally comprises at least one chromophore and further comprises at least one chromophore stripe or region. In another embodiment, the shaped object is incorporated into a paper product to detect counterfeiting.

In yet another embodiment, the shaped object retains its shape after incorporating in paper product.

In yet another embodiment, the shaped object is visible in transmitted light and is not visible in reflected light.

In one more embodiment, the nanocellulose composition comprises nanocellulose with at least one ingredient selected from binders or polymers selected from the group consisting of starch, polyvinyl alcohol, poly vinyl acetate and polar polymers, particles selected from the group consisting of fumed silica, calcium carbonate, clay and talc.

The nanocellulose is in the form of fibres and diameter of the nanocellulose fibres is in the range of 20 to 1000 nm.

The thickness of the shaped object is in the range of 10 μm to 100 μm.

The dimension of the shaped object is in the range of 0.5 mm to 6 mm.

The shape of the shaped object is selected from rupee symbol or cross symbol.

In one embodiment, the present invention provides a process for the preparation of shaped object comprising the steps of:

a) preparing nanocellulose or a composition thereof followed by making a film;
b) coating at least one fluorescent dye on to the surface of nanocellulose or a composition thereof to obtain a fluorescent dye coated nanocellulose product; and
c) preparing shaped object from the fluorescent dye coated nanocellulose product by using micromachining techniques such as laser cutting or directly solvent casting into sheet molds, punching or stamping.

In yet another embodiment, the present invention provides a paper product comprising at least one shaped object, wherein the shaped object is visible in transmitted light and is not visible in reflected light.

In preferred embodiment, the paper product is selected from A4 printing paper, bank note, stamp papers, passport papers, bank cheques or degree certificates.

In still another embodiment, the present invention provides a process for making paper product comprising at least one shaped object comprising the steps of:

a) preparing paper pulp with the consistency in the range of 1.2 to 1.7 wt %;
b) beating the pulp in valley beater to get required Schopper Riegler (SR) value ranging from 40 to 70;
c) combining the pulp of step (b) and the shaped object as claimed in claim 1 by continuous stirring with the overhead stirrer at a speed of 500 to 700 rpm for 20 to 30 minutes;
d) draining the pulp of step (c) in a semi-automatic sheet former machine to form paper product.

In preferred embodiment, the consistency of paper pulp is in the range of 1.2 to 1.57 wt %;

DETAILED DESCRIPTION OF THE INVENTION

Figure 1:
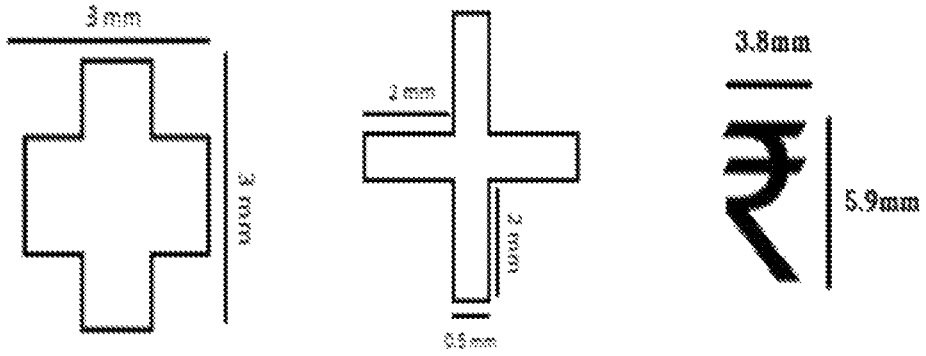
FIG. 1: shape or symbol of shaped objects
Figure 2:
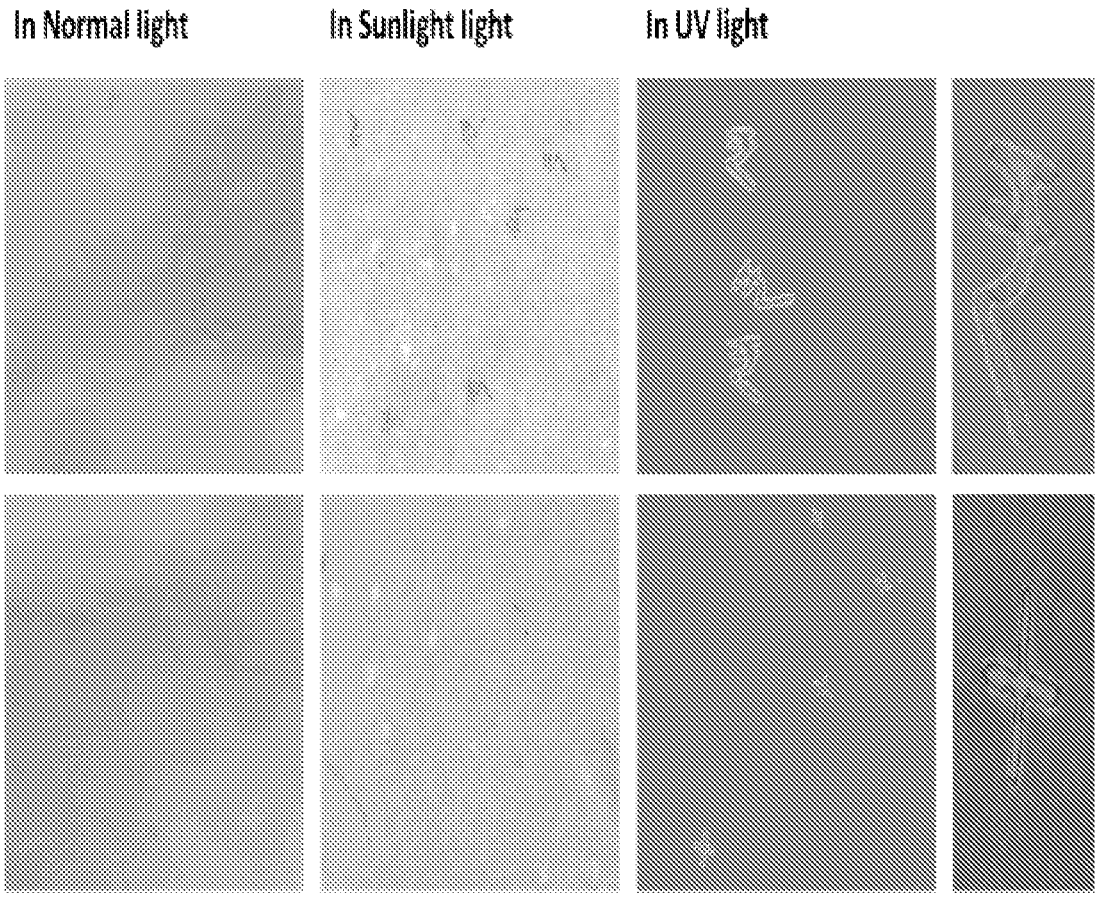
FIG. 2: Appearance of the security paper under different light conditions
Figure 3:
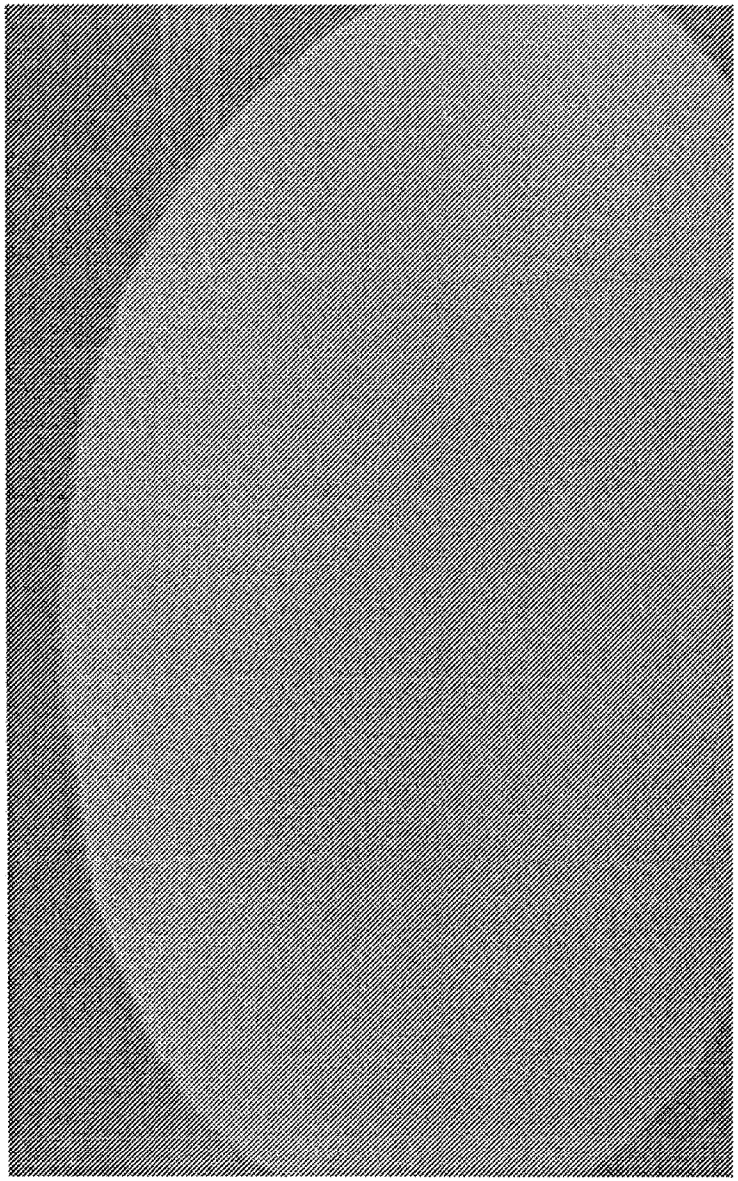
FIG. 3: The rupee or cross symbols included paper: nanocellulose-red dye coated rupee symbols; Total symbols—30, Appeared—29 (good condition); Symbol Thickness: 60μ

The invention will now be described in detail in connection with certain preferred and optional embodiments, so that various aspects thereof may be more fully understood and appreciated.

The terms "comprises", "comprising", or any other variations thereof, are intended to cover a non-exclusive inclusion, such that a composition, process that comprises a list of ingredients does not include only those ingredients but may include other ingredients not expressly listed or inherent to such composition or process. In other words, one or more elements in a product or process proceeded by "comprises . . . a" does not, without more constraints, preclude the existence of other elements or additional elements in the product or process.

The terminology used herein is for the purpose of describing particular embodiments only and is not intended to be limiting of example embodiments of the invention.

The term "object" is defined as any 2D or 3D material embedded in the paper.

The term "shaped object" is defined as one-dimensional fibre or shaped planar objects.

The term "Nanocellulose" used herein is defined as cellulosic materials (with and without chemical modifications) where in at least one of the dimensions of the fibril is <100 nm. Nanocellulose could consist of cellulose nanofibrils, cellulose nanocrystals, cellulose whiskers, microfibrillated cellulose etc.

Security documents are documents made of paper that need to identified or authenticated as genuine using security features and are selected from, but not limited to currency notes, passports, bonds, certificates, agreements, stamp or stamp paper, share certificates and such like.

Maintaining or retaining shape or shape integrity means retaining or maintaining shape as intended or prepared even after being subjected to various manufacturing steps, process, storage and use conditions.

Very high aspect ratio is aspect ratio greater than 5.

In the following detailed description of the aspects of the invention, reference is made to the accompanying examples that form part hereof and in which are shown by way of illustration specific aspects in which the invention may be practiced. The aspects are described in sufficient details to enable those skilled in the art to practice the invention, and it is to be understood that other aspects may be utilized and that charges may be made without departing from the scope of the present invention. The following description is, therefore, not to be taken in a limiting sense, and the scope of the present invention is defined only be the appended claims.

In line with the above objectives, the present invention provides a shaped object comprising nanocellulose alone or composition thereof for use in security application, wherein the shaped objects have high stiffness and will retain their shapes after incorporating in paper product. Further, the present invention provides paper products incorporating such shaped objects, wherein the shaped object is visible in transmitted light, but is not visible in reflected light.

In line with the above objectives, the present invention provides a shaped object comprising nanocellulose alone or composition thereof for use in security application, wherein the shaped objects have high stiffness and will retain their shapes after incorporating in paper product. Further, the present invention provides paper products incorporating such shaped objects, wherein the shaped object is visible in transmitted light, but is not visible in reflected light. Thus a security feature comprising nanocellulose alone or compositions of cellulose in the form of shaped objects is disclosed. This security feature finds applications in identifying and authenticating documents such as security documents.

Figure 5:
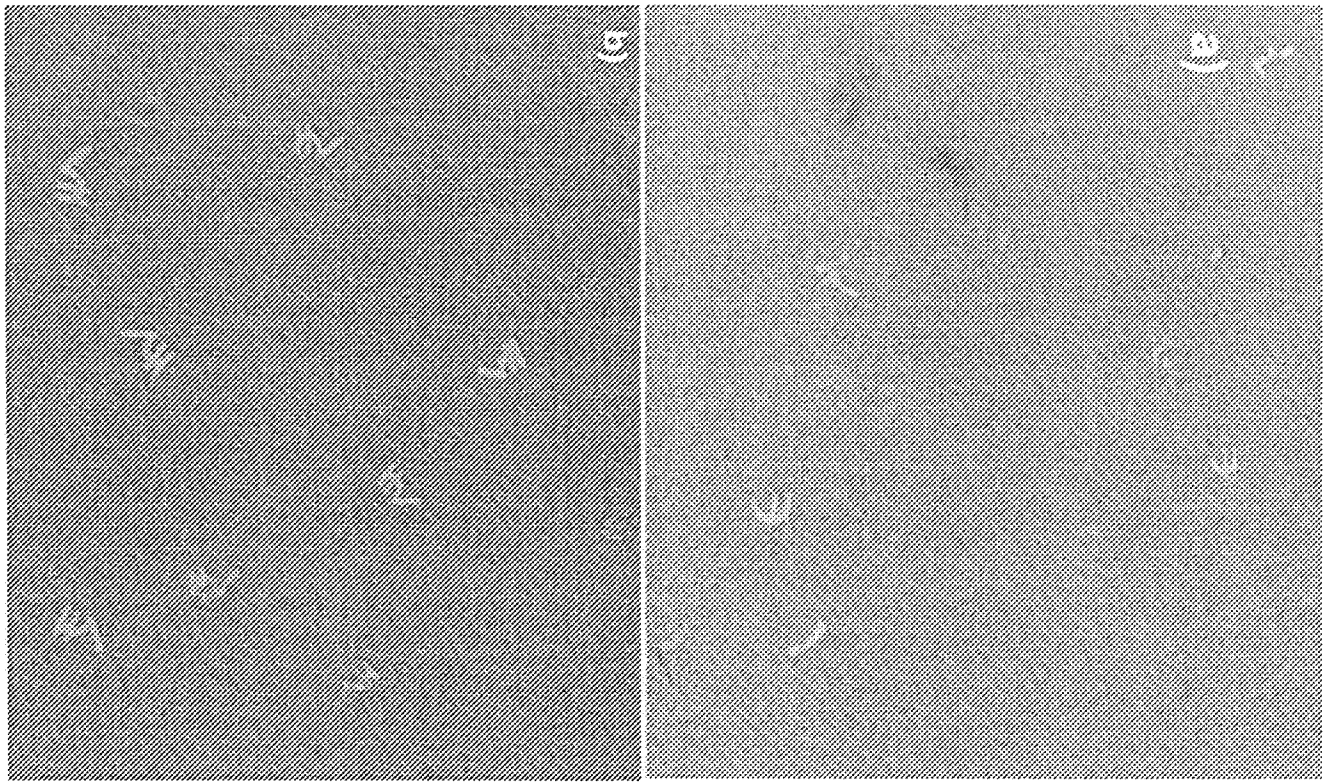
FIG. 5: a) Rupee symbol made from cellulosic paper embedded in a paper substrate, b) Rupee symbol made from nanocellulose film embedded in a paper substrate

A comparative study was performed between rupee shaped (`) objects with fluorescent ink, made from nanocellulose film and cellulosic paper of identical thickness (60 μm). These shaped objects are mixed with pulp and paper substrate and made using a semi-automatic sheet former. Referring to FIG. 5, it is apparent that shaped objects made from cellulosic paper (FIG. 5*a*) appear distorted, damaged and have lost their shape in the embedded paper, while those made from nanocellulosic film (FIG. 5*b*) appear intact and clear in the paper Images are obtained under UV light. From the above study, it is surprisingly observed that the problem of losing shape integrity using cellulose is overcome by the use of nanocellulose which maintains shape integrity of the shaped object introduced for authentication of security documents.

In the manufacturing process for preparing paper products or security documents the raw material is subjected to rigorous processes including pulping and beating, This results in the distortion of the shape of objects introduced for authenticating the security documents. This distortion is evident when cellulose is used for the preparation of the required shaped objects, refer FIG. 5*a*. This issue gets further compounded when the shaped objects intended for authentication are objects with high aspect ratio ie they are shaped such that they have protrusions and the length to width ratio of the protrusion ie their aspect ratio is very high. The size of the shaped objects being very small, they cannot be cut to the required shape easily, especially shapes that have protrusions with high aspect ratio. Both the issues, ie the retiming or maintaining of shape integrity as well as easy introduction of miniaturized shaped objects into the security document without cutting them to shape in addressed in the instant invention.

Thus, the long standing problem of having a non-distorted shaped security feature to detect counterfeiting of paper products which can be easily implemented to authenticate genuineness of paper products and security documents is resolved by the provision of nanocellulose or nanocellulosic compositions in the form of shaped objects of the present invention.

In an embodiment, the present invention provides shaped object comprising nanocellulose alone or composition thereof optionally comprising at least one chromophore for use in security application.

In an embodiment, the present invention provides shaped object comprising nanocellulose alone or composition thereof optionally comprising at least one chromophore selected from a fluorescent dye or ink for use in security application.

In a preferred embodiment, the shaped object is suitable for incorporation into a paper product for use in counterfeit detection and identification/authentication of the paper product.

In one embodiment, the nanocellulose is in the form of fibres and the diameter of the nanocellulose fibres is in the range of 20 nm to 1000 nm.

The thickness of the shaped object is in the range of 10 μm to 100 μm. The dimension of shaped object is in the range of 0.5 mm to 6 mm. The shaped object may have a maximum dimension of 6 mm. However other dimensions such as maximum dimensions of 1 mm, 2 mm, 3 mm, 4 mm or 6 mm are possible.

The shape of shaped object of the present invention is non-rectilinear, circular, non-circular and/or irregular. Particularly, the shaped object of the present invention contains protrusions of very high aspect ratio. The aspect ratio for protrusions of the shaped objects of the invention is in the range of 5-1000. In a preferred embodiment, shape of the shaped object is selected from rupee symbol or cross symbol (+).

In yet another embodiment, the nanocellulose composition comprises nanocellulose along with at least one ingredient selected from binders or polymers such as starch, polyvinyl alcohol, poly vinyl acetate or other polar polymers, particles such as fumed silica, calcium carbonate, clay, talc etc.

The shaped object of the present invention is prepared by mixing the nanocellulose alone or composition thereof with at least one chromophore.

The term "mixing" as used herein refers to physical mixing to form composite, chemical modification with chromophore molecules, coating, spray drying or printing. In one embodiment of the present invention, the chromophore can be applied on to the nanocellulose film by using various techniques like coating or spray drying or printing.

The shaped object is prepared by coating at least one chromophore on to the surface of nanocellulose film.

In preferred embodiment, the present invention provides the process for the preparation of shaped object comprising the steps of:

a) preparing nanocellulose or a composition thereof followed by making a film;
b) coating at least one fluorescent dye on to the surface of nanocellulose or a composition thereof to obtain a fluorescent dye coated nanocellulose product; and
c) preparing shaped object from the fluorescent dye coated nanocellulose product by using micromachining techniques such as laser cutting or directly solvent casting into sheet molds, punching or stamping.

In preferred embodiment, the fluorescent dye is of red colour fluorescent dye. In another preferred embodiment, the fluorescent dye is of blue colour fluorescent dye. In yet another preferred embodiment, the fluorescent dye is of green colour fluorescent dye.

In one embodiment of the present invention, the nanocellulose fibres can be chemically modified with fluorescent molecules and these modified nanocellulose fibres can be cast into a film. In another embodiment, various fluorescent dyes of specific pattern or order can also be printed on the nanocellulose film by inkjet or other printing techniques.

The shaped object may comprise a plurality of regions, such as a repeating pattern of regions. Further, the regions may be striped regions, which may form a repeating pattern. In one embodiment, the invention in which the shape of the shaped object can be considered to be a symbol, the striped regions may be diagonal relative to that symbol.

The regions may include regions having two colours. The fibre may comprise only two regions, with each region having a different colour. In one embodiment of the invention, two regions are provided with each covering half of the shaped object.

In another embodiment, the present invention provides a process for the preparation of nanocellulose comprising the steps of:

a) cutting the nanocellulose source material into small pieces;
b) subjecting the alkali treatment by washing the pieces of step (a) with base for 4 to 5 hours under mechanical stirring to form fibres;
c) subjecting the fibres of step (b) to bleaching treatment with bleaching solution at the temperature ranging from 70° C.-80° C. for the time period ranging from 3 to 4 h; repeating process for 2 to 3 times to afford pulp;
d) filtering and rinsing the pulp of step (c) followed by grinding the pulp in ultra-fine micro grinder to afford nanocellulose.

In a preferred embodiment, the nanocellulose source material is selected from sugarcane bagasse, sisal plant, banana fibres, cotton rags or other plant sources.

In another preferred embodiment, in the alkali treatment the sugarcane is washed with 1-4% sodium hydroxide (NaOH) at 50 to 60° C.

The fiber to liquor ratio are maintained 1:30 for both alkali and bleaching treatment.

The bleaching solution of step (c) comprises 1:1 ratio of aqueous sodium hypochlorite (NaOCl in water) and an acetate buffer (NaOH and glacial acetic acid, diluted to 1 L using distilled water).

The nanocellulose film is prepared by dispersing known amount of the aqueous suspension of nanocellulose on glass petri dish followed by drying at ambient conditions. At least one fluorescent dye is applied on to the surface of nanocellulose film and allowed to dry under ambient conditions. The rupee and cross symbols are cut from the fluorescent nanocellulose film. The symbols then mixed with A4 recycled paper pulp for more than 20 min in continues stirring with the overhead stirrer speed 500 rpm to afford the shaped object of desired size and shape.

The thickness of the shaped object is in the range of 30-50 μm. In preferred embodiment, the symbols are cutted by using the various micromachining techniques but not limited to laser cutting. In more preferred embodiment, the symbols are cutted by using LASER cutting machine with speed 50 mm/sec and power 11%.

The present invention also provides a method of manufacturing a paper product, the method comprising the steps of mixing one or more shaped objects of the present invention with slurry paper pulp and forming continuous web of paper.

In another embodiment, the present invention provides a process for making paper products whereby the shaped object is suitable for mixing with slurry paper pulp for paper formation. In preferred embodiment, the paper product is selected from A4 printing paper, bank note, stamp papers, passport papers and any other security documents.

In still yet another embodiment, the present invention provides a process for making paper using shaped object comprises the steps of:

a) preparing paper pulp with the consistency in the range of 1.2 to 1.7 wt %;
b) beating the pulp in valley beater to get required Schopper Riegler (SR) value ranging from 40 to 70;
c) combining the pulp of step (b) and the shaped object as claimed in claim 1 by continuous stirring with the overhead stirrer at a speed of 500 to 700 rpm for 20 to 30 minutes;
d) draining the pulp of step (c) in a semi-automatic sheet former machine to form paper product.

In preferred embodiment, the consistency of paper pulp is in the range of 1.2 to 1.57 wt %;

The paper is selected from A4 printing paper, bank note, stamp papers, passport papers bank cheques or degree certificates and any other security documents.

In one embodiment, the shaped object in accordance with the present invention are intended to be incorporated into a paper product such as a bank note, cheques, passports, identity papers as a counterfeit protection device.

In another embodiment of the invention, the shaped objects incorporated into paper products are not visible in ordinary light conditions. Thus, the normal appearance of the paper product is not affected by the incorporation of the shaped objects into the paper. The shaped objects are visible in transmitted light, but are not visible in reflected light.

The paper thus produced having shaped object incorporated therein doesn't reveal the symbols these symbols are invisible in reflected light. But, when the paper is held against sunlight or any backlight, symbols are visible and they exhibit fluorescence under UV light of 356 nm (FIG. 1).

To confirm the distortion of shaped objects in of the present invention in the paper products the paper product are prepared using rupee or cross symbols of different thickness by including them in paper of different thickness (table 3). The results shows that a cross symbol coated with red colour fluorescent dye of thickness 75μ included in paper of thickness 120μ shows the total number of symbol appeared on the paper without any defect are 40 out of 50 symbols inserted. Similarly, the rupee symbol coated with red colour fluorescent dye of thickness 58μ and 60μ included in paper of thickness 86μ shows the total number of symbol appeared on the paper without any defect are 23/25 and 29/30 respectively.

Figure 4:
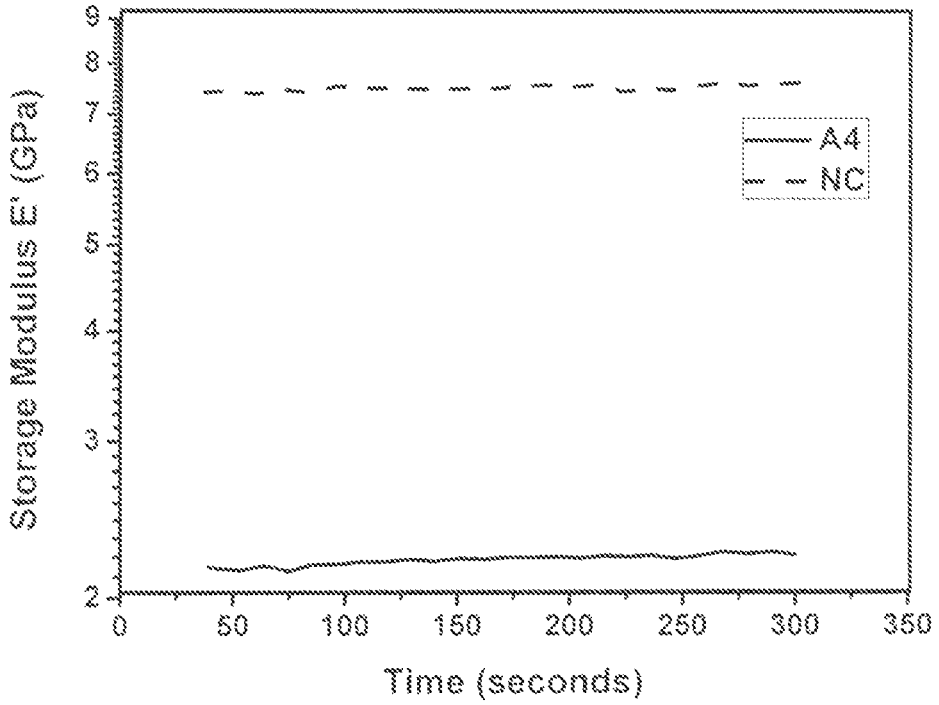
FIG. 4: Elastic modulus of the nanocellulose film versus A4 recycled paper.

The FIG. 4 shows the elastic modulus of the nanocellulose film versus A4 recycled paper. From FIG. 4 it is observed that the nanocellulose film shows significantly higher modulus which provides higher bending rigidity preventing it from folding or getting distorted during inclusion in the paper manufacturing process (FIG. 4).

The following examples, which include preferred embodiments, will serve to illustrate the practice of this invention, it being understood that the particulars shown are by way of example and for purpose of illustrative discussion of preferred embodiments of the invention.

EXAMPLES

Following examples are given by way of illustration therefore should not be construed to limit the scope of the invention.

Example 1: Process of Nanocellulose Preparation

The nanocellulose source material (sugarcane bagasse) was subjected to the alkali treatment by washing the pieces with NaOH for 4 hours under mechanical stirring to form fibres. The fibres are then subjected to bleaching treatment with bleaching solution which comprises 1:1 ratio of aqueous sodium hypochlorite (NaOCl in water) and an acetate buffer (NaOH and glacial acetic acid, diluted to 1 L using distilled water) at the temperature 70° C. for 4 h; repeating the process for 2 to 3 times to afford pulp. The pulp as obtained is then filtered and rinsed followed by grinding in ultra-fine micro grinder to afford nanocellulose.

Example 2: Process for Making Shaped Objects from Nanocellulose a) Process of Preparing Nanocellulose Film:

Nanocellulose film was prepared by dispersing known amount (5-10 mg/mL) of the aqueous suspension of nanocellulose on glass petri dish followed by drying at 25 to 35° C. for 2 days.

b) Coating of Paper and Nanocellulose Film:

The red fluorescent dye was applied by brush on nanocellulose film and allowed to dry under 25 to 35° C.

c) Shaped Symbols from Fluorescent Nanocellulose Film:

The following shaped symbols were cut from the nanocellulose film having thickness 30-50 μm in range. The rupee and cross symbols, were cut from the fluorescent nanocellulose film by LASER cutting machine with speed 50 mm/sec and power 11%. The given symbols then mixed with A4 recycled paper pulp for more than 20 min in continues stirring with the overhead stirrer speed 500 rpm. The rupee or cross symbols included paper was prepared on the semi-automated sheet former and the following observations were observed shown in table.

| r. no. | Sample name | Symbol used | Paper thickness μ | Symbol thickness μ | No of symbol appeared on the paper without any defect |
|---|---|---|---|---|---|
| 1 | NC | ` | 84 | 50 | 30/30 |
| 2 | NC - Red dye | + (3 mm × 3 mm) | 120 | 75 | 40/50 |
| 3 | NC - red dye | ` | 86 | 58 | 23/25 |
| 4 | NC - red dye | ` | 86 | 60 | 29/30 |
| 5 | NC - blue dye | ` | 84 | 90 | 22/25 |

Example 3: Process for Making Shaped Objects from Nanocellulose Directly

Nanocellulose based miniature shaped objects are also made directly by using solvent casting nanocellulose dispersion in sheet molds or dye coated nanocellulose films which are converted into a plurality of shaped objects by stamping, punching etc.

Example 4: Paper Making Process with Shaped Objects

The A4 printing paper pulp with the consistency of 1.2-1.57 wt % was prepared. Then the pulp was beated in valley beater to get required SR value, e.g. 40, 50, or 60 as per requirement. The A4 recycled pulp and the rupee or cross symbols are combined by continues stirring with the overhead stirrer at a speed of 500 rpm for 20 minutes and then draining the pulp in a semi-automatic sheet former machine to form paper.

Example 5: Comparative Elastic Modulus for Nanocellulose Film and A4 Printing Recycled Paper The elastic modulus of the nanocellulose film and A4 recycled paper was determined using dynamic mechanical analyser by a time sweep at 30° C. and 1 Hz frequency. Significantly higher modulus of nanocellulose film provides higher bending rigidity preventing it from folding or getting distorted during inclusion in the paper manufacturing process (FIG. 4).

Advantages of Invention

1. Symbols of complex shape are easily incorporated in the paper product without getting distorted.
2. The nanocellulose based shaped objects of the present invention is of high stiffness.
3. The shaped object of present invention shows less water absorption/swelling when introduced in pulp.
4. Shaped objects in the paper could be detected easily when held against visible light without any instruments.
5. Shaped objects being made from cellulosic source is compatible with paper.
6. Could be processed in existing paper making machinery.

The invention claimed is:

1. A security feature comprising nano cellulose alone or a composition of nano cellulose, in a form of a shaped object to identify or authenticate a security document, wherein the shaped object has protrusions with an aspect ratio of greater than 5, and wherein the shaped object additionally comprises at least one chromophore, at least one chromophore stripe or a chromophore region.

2. The security feature as claimed in claim 1, wherein said nanocellulose composition comprises nanocellulose with at least one ingredient selected from binders or polymers selected from the group consisting of starch, polyvinyl alcohol, poly vinyl acetate and polar polymers, particles selected from the group consisting of fumed silica, calcium carbonate, clay and talc.

3. The security feature as claimed in claim 1, wherein said shaped object is incorporated into a paper product to detect counterfeiting.

4. The security feature as claimed in claim 1, wherein said shaped object comprises at least one fluorescent stripe or region.

5. The security feature as claimed in claim 1, wherein said shaped object retains a shape after being incorporated into a paper product.

6. The security feature as claimed in claim 1, wherein said shaped object is visible in transmitted light and is not visible in reflected light.

7. The security feature as claimed in claim 1, wherein said nanocellulose is in a form of fibres and diameter of said nanocellulose fibres is in the range of 20 to 1000 nm.

8. The security feature as claimed in claim 1, wherein thickness of said shaped object is in the range of 10 μm to 100 μm.

9. The security feature as claimed in claim 1, wherein the dimension of shaped object is in the range of 0.5 mm to 6 mm.

10. The security feature as claimed in claim 1, wherein said shaped object is prepared by a process comprising steps of:

a) preparing nanocellulose or a composition thereof followed by making a film;

b) coating at least one fluorescent dye on to a surface of nanocellulose or a composition thereof to obtain a fluorescent dye coated nanocellulose product; and c) preparing the shaped object from the fluorescent dye coated nanocellulose product by using micromachining techniques selected from one of laser cutting, directly solvent casting into sheet molds, punching or stamping.

11. A paper product comprising at least one shaped object as claimed in claim 1, wherein said shaped object is visible in transmitted light and is not visible in reflected light.

12. The paper product as claimed in claim 11, wherein the paper product is selected from A4 printing paper, bank note, stamp papers, passport papers, bank cheques or degree certificates.

13. A process for making paper product comprising at least one shaped object as claimed in claim 11, the process comprising the steps of:

a) preparing paper pulp with a consistency in a range of 1.2 to 1.7 wt %;

b) beating the pulp in a valley beater to get required Schopper Riegler (SR) value ranging from 40 to 70;

c) combining the pulp of step (b) and the shaped object as claimed in claim 1 by continuous stirring with a overhead stirrer at a speed of 500 to 700 rpm for 20 to 30 minutes;

d) draining the pulp of step (c) in a semi-automatic sheet former machine to form paper product.

14. The process as claimed in claim 13, wherein consistency of paper pulp is in the range of 1.2 to 1.57 wt %.

15. The process as claimed in claim 13, wherein the paper is selected from A4 printing paper, bank note, stamp papers, passport papers, bank cheques or degree certificates.

16. The process as claimed in claim 13, wherein said shaped object retains a shape after being incorporated into a paper product.

17. The process as claimed in claim 13, wherein shape of said shaped object is selected from rupee symbol or cross symbol.

* * * * *